United States Patent [19]

Jungblut et al.

[11] Patent Number: 5,046,428

[45] Date of Patent: Sep. 10, 1991

[54] SHELL FOR A PROPELLANT CHARGE

[75] Inventors: Ernst D. Jungblut, Herschback; Werner Knopf, Vallendar; Gerald Rotter, Weitersburg, all of Fed. Rep. of Germany

[73] Assignee: Hubner Gummi-und Kunststoff GmbH, Kassel, Fed. Rep. of Germany

[21] Appl. No.: 371,715

[22] Filed: Jun. 27, 1989

[30] Foreign Application Priority Data

Jun. 28, 1988 [DE] Fed. Rep. of Germany ..... 3821669

[51] Int. Cl.[5] ..... F42B 5/26

[52] U.S. Cl. ..... 102/469; 102/467; 102/464

[58] Field of Search ..... 102/469, 464, 467, 470

[56] References Cited

U.S. PATENT DOCUMENTS

| | | | |
|---|---|---|---|
| 259,237 | 6/1882 | Stocking | 102/469 |
| 865,853 | 9/1907 | Bailey | 102/469 |
| 1,187,464 | 6/1916 | Offcutt | 102/469 |
| 3,242,789 | 3/1966 | Woodring | 102/467 |
| 4,159,678 | 7/1979 | Luther et al. | 102/469 |
| 4,796,535 | 1/1989 | Bertiller | 102/464 |

FOREIGN PATENT DOCUMENTS

| | | | |
|---|---|---|---|
| 1093151 | 5/1955 | France | 102/467 |
| 0014814 | of 1889 | United Kingdom | 102/469 |
| 0007321 | of 1894 | United Kingdom | 102/469 |

*Primary Examiner*—Charles T. Jordan
*Assistant Examiner*—Michael J. Carone
*Attorney, Agent, or Firm*—Alan H. Levine

[57] ABSTRACT

The case of a composite propellent charge cartridge exhibits cracks, after shooting, at the sharp transition of the extractor rim. This has a disadvantageous effect on the number of possible reloadings. The present case permits frequent reloading with little reconditioning. A rotationally symmetrical molding is placed on the case, and at least partially forms the extractor rim. The surface of the case that is in contact with the molding is rounded and smoothed at least at highly stressed points. The reusable cartridge case, with the molding, is suitable for composite propellent charge cartridges.

6 Claims, 2 Drawing Sheets

SHELL FOR A PROPELLANT CHARGE

Figure 1:
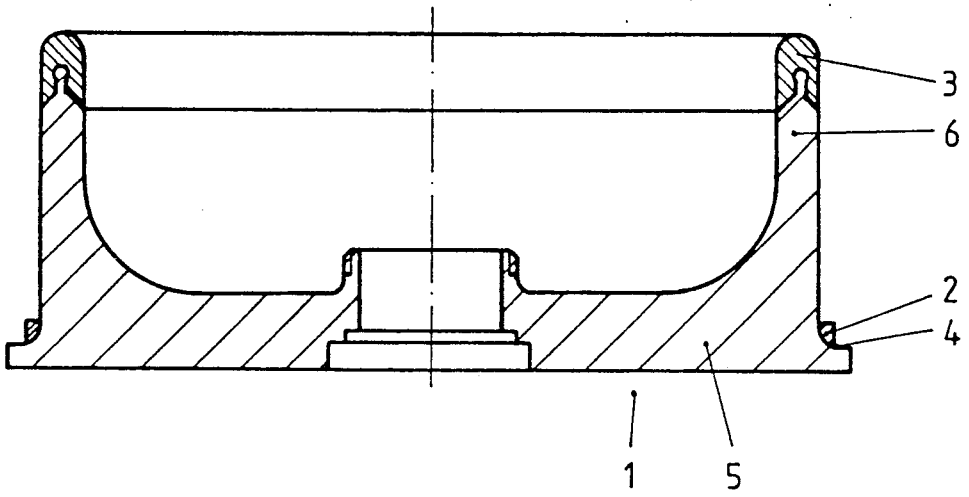

This invention relates to a composite shell for a propellent charge, consisting of a cartridge tube and a catridge case, the base of the case being provided with an extractor rim on its circumference, and a circumferential elastic cuff being placed on the tubular portion of the case.

German OS 23 03 790 discloses a propellent charge cartridge having a reusable case and a snap-on elastic cuff joined to the case for prolonging its life. Additional components of the propellent charge shell, such as the combustible tube or the primer seat, are shown in German OS 26 41 665.

When fired, the case is stretched due to the high peaks of pressure occurring in the barrel of the weapon. The cracks that are formed by such stretching are apparent mostly at the sharp transitions of the extractor rim and at the seat of the snap-on cuff.

The expensive reconditioning of the cartridge case by machining is performed by turning down the surface weakened by the cracks. The cracks on the nicked extractor rim prove critical in this case. The necessary cutting in the form of a radiused cove results in a thinning of the base of the cartridge. Consequently no more than two reloadings are possible. In addition to cracking, damage is also done to the extractor rim when the shell is ejected from the gun barrel.

The invention addresses the problem of permitting frequent reloading of the expensive cartridge case without costly reconditioning.

This problem is solved in accordance with the invention by the following features:

- a rotationally symmetrical molding is provided on the case,
- the molding at least partially forms the extractor rim, and
- the surface of the case that is joined to the molding is rounded and smoothed, at least at severely stressed areas.

The advantages achieved by the invention consist especially in the fact that cracking no longer occurs at the extractor rim of the cartridge case, since the rotationally symmetrical molding forms the indented, crack-sensitive extractor rim and the case is rounded and smooth in this area and thus rendered insensitive to cracking. This eliminates the expensive machining in this area, and accordingly avoids thinning the cartridge base, and this in turn increases the number of possible reconditionings. When the case is ejected from the barrel of the gun, damage is done only to the molding, which is not reused.

In accordance with various configurations of the inventions,

- the molding also at least partially covers the outer circumference of the tube,
- the molding additionally covers the outer circumference of the tube and at least partially covers the circular outer end surface of the tube and the inner circumference of the tube, and
- the molding additionally covers the outer circumference of the tube and is prolonged to form the cartridge tube.

The molding first protects the case against damage and, furthermore, if the inner circumference of the tube is lined, it protects it against thermal stress.

An advantageous additional development of the above-listed configurations is obtained when the elastic cuff is made on the molding. This eliminates the expensive machining on the snap-on seat for the cuff on the cartridge case. Assembly of the sealing cuff is simplified by vulcanizing it onto the molding, since the latter is light, convenient and quickly heated.

Sizing the case to correct plastic deformation further simplifies the reconditioning of the case, since the machining operation is eliminated and all that is needed is cleaning and examination prior to reuse.

Embodiments of the invention will now be further explained with the aid of the drawing, wherein :

FIG. 1–FIG. 5 illustrate differently constructed cartridge cases in longitudinal section.

A composite propellent charge cartridge consisting of a tube and a case, in which the bottom of the case is provided with an extractor rim around its circumference, and in which a circumferential elastic cuff is provided on the tube of the case, is described herein.

In FIG. 1–FIG. 5 a rotationally symmetrical molding 2 is placed on the cartridge case 1. The material of the molding 2 can be a metal, such as steel or brass, or a plastic, depending on the required mechanical and thermal stability. The molding 2 can be fastened to the case 1 positively, e.g., by pinning or cementing, force-fitting, e.g., by shrinking it on, or materially, e.g., by soldering.

Figure 2:
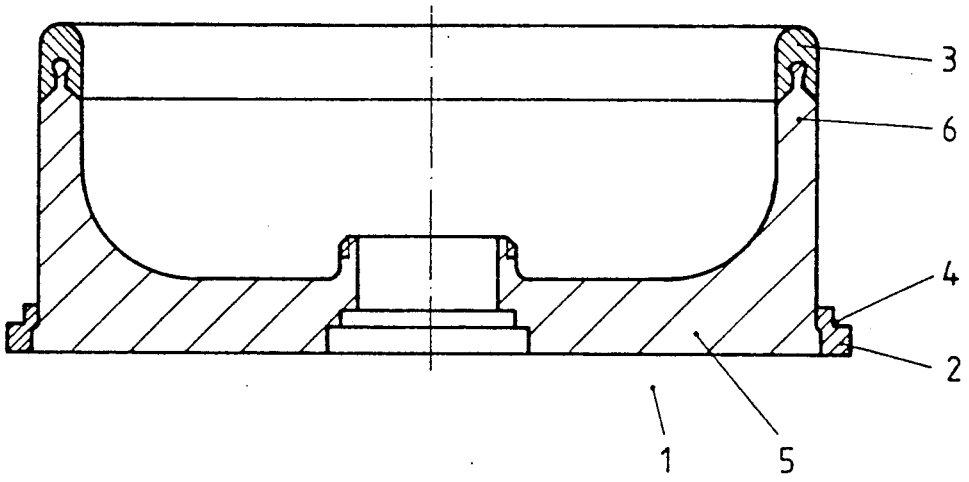

In FIG. 1 the molding 2 forms part of the extractor rim 4, while in FIG. 2 the molding 2 forms the entire extractor rim. The surface of the cartridge base 1 connected with the molding 2 is rounded and smooth.

The embodiments shown in FIGS. 1 and 2 are very suitable for increasing the number of reloadings of the cartridge case 1 without great changes in its construction.

Figure 3:
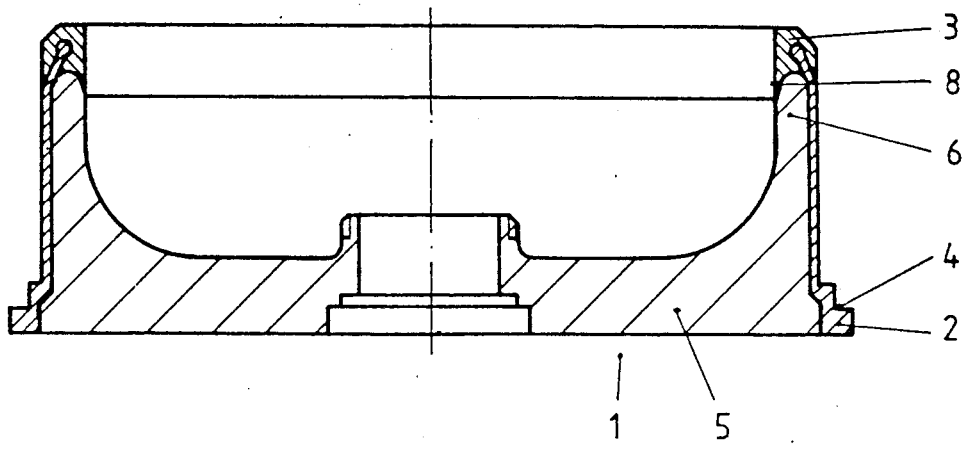
Figure 4:
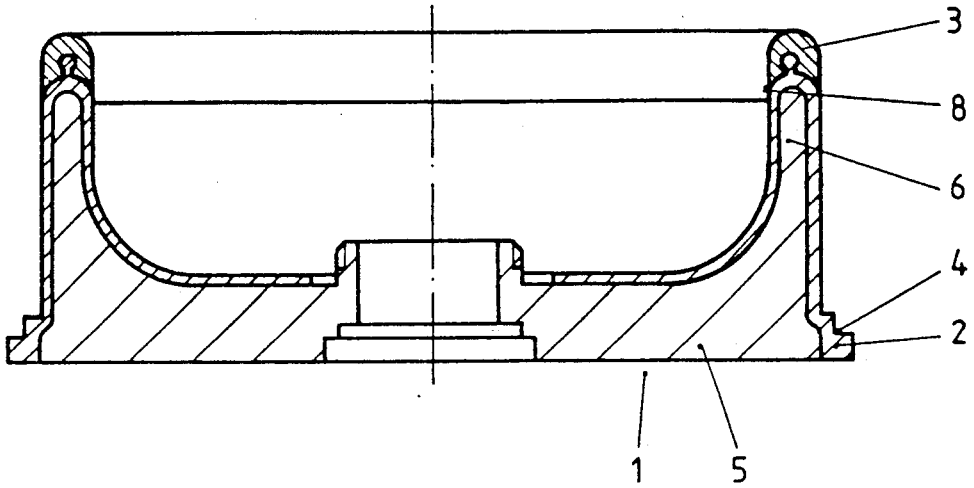

In FIG. 3 the molding 2 forms the extractor rim 4 and covers the outer circumference of the tubular portion 6. On the other hand, the molding 2 in FIG. 4 additionally covers the circular top rim and the inner periphery of the tubular portion 6 of the case.

Figure 5:
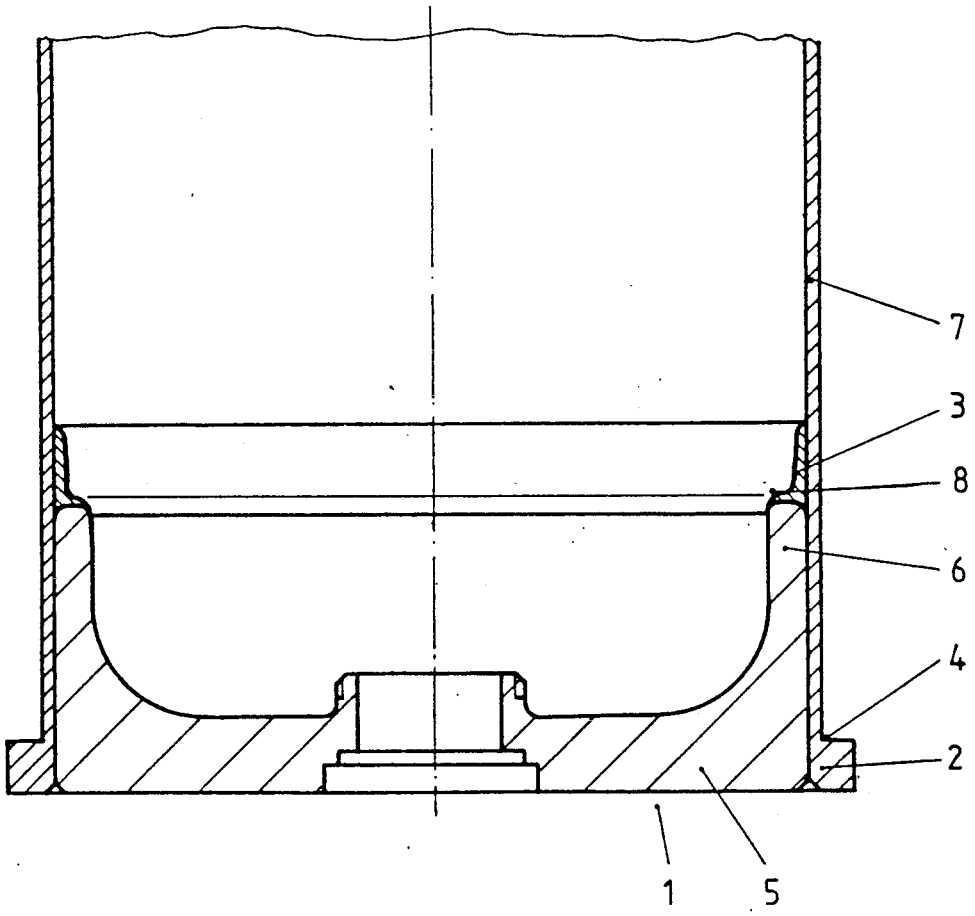

FIGS. 1 to 4 show variations of the cartridge case 1 for shot loads with a combustible tube which is not shown in the drawing. FIG. 5, however, shows a configuration for ammunition with an incombustible tube, in which the molding forms the extractor rim and covers the outer circumference of the tube. Beyond the tube the molding 2 is elongated to form the shot tube 7.

It can be seen in FIGS. 2 to 5 that the elastic cuff 3 is provided on the molding. In a known manner, the two parts can be joined together positively by cementing or vulcanizing or, as described in German OS 23 03 790, in a snap-on manner. When the pressure builds up in the shell in the case of the example in FIG. 3, the seal overlap 8 is urged against the tubular portion 6 of the case.

The seal between molding 2 and case 1, in the case of the cartridge with an incombustible tube in accordance with FIG. 5, functions in a similar manner. The elastic cuff 3 fastened only to the molding again has an overlap 8 which rests on the circular top rim of the case. The urging of the cuff against the case when the pressure builds up produces a secure sealing action.

We claim:

1. A composite propellent charge cartridge comprising:

a cartridge case having a bottom portion and a tubular portion, and an extractor rim extending circumferentially around the bottom portion of the case, a molding surrounding the cartridge case, the molding at least partially forming the extractor rim, and an elastic cuff carried by the tubular portion of the case, the cuff being joined to the molding.

2. A cartridge as defined in claim 1 wherein the surface of the case in contact with the molding is smooth and rounded, at least at areas subjected to high stress.

3. A cartridge as defined in claim 1 wherein the molding covers at least part of the outer surface of the tubular portion of the cartridge case.

4. A cartridge as defined in claim 1 wherein the molding covers the outer surface, and at least part of the end surface, of the tubular portion of the cartridge case.

5. A cartridge as defined in claim 1 wherein the molding covers the outer surface, end surface, and at least part of the inner surface of the tubular portion of the cartridge case.

6. A cartridge as defined in claim 1 wherein the molding covers the outer surface of the tubular portion and extends beyond the end surface of the tubular portion to define the cartridge shaft.

* * * * *